US006289225B1

(12) United States Patent
Rudisill et al.

(10) Patent No.: US 6,289,225 B1
(45) **Date of Patent: *Sep. 11, 2001**

(54) RETRACTABLE AND PIVOTABLE MULTIPLE FREQUENCY BAND ANTENNA

(75) Inventors: Charles Albert Rudisill, Apex; Gerard James Hayes, Wake Forest; Russell Evans Winstead, Raleigh, all of NC (US)

(73) Assignee: Ericsson Inc., Research Triangle Park, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 51 days.

(21) Appl. No.: 09/135,979

(22) Filed: Aug. 17, 1998

(51) Int. Cl.[7] ..... H04B 1/38; H04M 1/00; H01Q 1/26; H01Q 1/24

(52) U.S. Cl. ..... 455/550; 455/90; 455/575; 343/702; 343/701

(58) Field of Search ..... 455/575, 90, 281, 455/193.2, 193.1, 121, 280, 550; 343/702, 701, 889

(56) References Cited

U.S. PATENT DOCUMENTS

| | | | | |
|---|---|---|---|---|
| 5,625,688 | * | 4/1997 | Ford et al. | 379/433 |
| 5,659,889 | * | 8/1997 | Cockson | 455/575 |
| 5,664,015 | * | 9/1997 | Ford et al. | 379/433 |
| 5,754,141 | * | 5/1998 | Thompson et al. | 343/702 |
| 5,779,496 | * | 7/1998 | Bolinger et al. | 439/377 |
| 5,940,039 | * | 8/1999 | Wang et al. | 343/702 |
| 6,016,431 | * | 1/2000 | Holshouser | 455/550 |
| 6,043,781 | * | 3/2000 | Toh et al. | 343/702 |

FOREIGN PATENT DOCUMENTS

| | | |
|---|---|---|
| 0 590 534 A | 4/1994 | (EP) . |
| 0 675 562 A | 10/1995 | (EP) . |
| 0 722 195 A | 7/1996 | (EP) . |
| 0 806 809 A | 11/1997 | (EP) . |
| 0 831 545 A | 3/1998 | (EP) . |

OTHER PUBLICATIONS

PCT International Search Report, PCT International Application No. PCT/US99/15117 (Jun. 10, 1999).

* cited by examiner

*Primary Examiner*—Fan Tsang
*Assistant Examiner*—Sheila Smith
(74) *Attorney, Agent, or Firm*—Myers Bigel Sibley & Sajovec

(57) ABSTRACT

A pivotable and retractable antenna contains mechanical and electrical components for connecting to, and matching the impedance of, radio frequency circuitry within an electronic device, such as a radiotelephone. A dielectric substrate has one end movably mounted to the housing of a radiotelephone and an opposite free end. The end movably mounted to the housing is configured to move into various positions to allow the dielectric substrate to have a first extended position, a second extended position and a retracted position. In a first extended position, the dielectric substrate extends along a longitudinal direction defined by the radiotelephone housing. In a second extended position, the dielectric substrate free end is pivoted away from the radiotelephone in a direction transverse to the longitudinal direction of the housing.

37 Claims, 8 Drawing Sheets

RETRACTABLE AND PIVOTABLE MULTIPLE FREQUENCY BAND ANTENNA

FIELD OF THE INVENTION

The present invention relates generally to radiotelephones, and, more particularly, to retractable antenna systems for use with radiotelephones.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Many radiotelephones, particularly handheld radiotelephones, employ retractable antennas which may be extended out of, and retracted back into, a radiotelephone housing. Conventionally, retractable antennas are electrically connected to a printed circuit board containing radio frequency circuitry located within a radiotelephone housing. A conventional radiotelephone antenna is typically interconnected with the radio frequency circuitry such that impedance of the antenna and the radio frequency circuitry are substantially matched. Conventionally, an antenna and radio frequency circuitry are matched at about 50 ohms (Ω) impedance.

Impedance matching for retractable antennas may be difficult because antenna impedance may be dependent on the position of an antenna with respect to both a radiotelephone housing and internal radio frequency circuitry. When a retractable antenna is moved between extended and retracted positions, at least two different impedance states, may be exhibited.

Accordingly, with retractable antennas, it is generally desirable to provide an impedance matching system with dual circuits that provide an acceptable impedance match between an antenna and the radio frequency circuitry, both when the antenna is retracted, and when the antenna is extended. Unfortunately, dual impedance matching circuitry can be somewhat complex and can increase the manufacturing costs of radiotelephones.

In addition, separate sets of signal line terminals or contacts are often used with impedance matching circuits to electrically connect a respective matching circuit to an antenna element. Unfortunately, multiple feed contacts may add to the complexity of the design and manufacturing of radiotelephones. Furthermore, multiple feed contacts may require multiple mechanical parts, such as spring contacts, that may become unreliable over time.

Many of the popular hand-held radiotelephones are undergoing miniaturization. Indeed, many of the contemporary models are only 11–12 centimeters in length. Unfortunately, as radiotelephones decrease in size, the amount of internal space therewithin may be reduced correspondingly. A reduced amount of internal space may make it difficult for retractable antennas to achieve the bandwidth and gain requirements necessary for radiotelephone operation because antenna size may be correspondingly reduced. Furthermore, radiotelephone antennas may not function adequately when in close proximity to a user during operation, or when a user is moving during operation of a device. Close proximity to objects or movement of a user during operation of a radiotelephone may result in degraded signal quality or fluctuations in signal strength, known as multipath fading.

It is also becoming desirable for a radiotelephone antenna to be able to resonate over multiple frequency bands. For example, the Japanese Personal Digital Cellular (PDC) system utilizes two "receive" frequency bands and two "transmit" frequency bands. Accordingly, radiotelephone antennas used in the Japanese PDC system should preferably be able to resonate in each of the two receive frequency bands. Unfortunately, the ability to provide retractable antennas with adequate gain over multiple frequency bands may be presently limited because of size limitations imposed by radiotelephone miniaturization.

SUMMARY OF THE INVENTION

It is, therefore, an object of the present invention to provide simplified impedance matching between retractable radiotelephone antennas and internal radio frequency circuitry.

It is another object of the present invention to provide retractable radiotelephone antennas with impedance matching systems that can have fewer mechanical parts than conventional matching systems.

It is another object of the present invention to provide retractable antennas that can resonate over multiple frequency bands with sufficient gain for use within small personal communication devices such as radiotelephones.

These and other objects of the present invention are provided by a pivotable and retractable antenna that contains all the mechanical and electrical components necessary for connecting to, and matching the impedance of, radio frequency circuitry within an electronic device, such as a radiotelephone. An antenna, according to an embodiment of the present invention, includes a dielectric substrate with one end movably mounted to the housing of a radiotelephone and an opposite free end. The end movably mounted to the housing of a radiotelephone is configured to move into various positions to allow the dielectric substrate to have a first extended position, a second extended position and a retracted position. In a first extended position, the dielectric substrate extends along a longitudinal direction defined by the radiotelephone housing. In a second extended position, the dielectric substrate free end is extended outwardly from the housing and pivoted away from the housing in a direction transverse to the longitudinal direction of the housing. When in a second extended position, the effects of interference caused by a user's body can be reduced.

First and second radiating elements are disposed on the dielectric substrate adjacent the free end and are configured to resonate within respective first and second frequency bands. A first set of contacts are provided on the dielectric substrate and serve as means for electrically connecting the first and second radiating elements to the radiotelephone transceiver via a set of fixed contacts within the radiotelephone when the dielectric substrate is in a retracted position. The set of fixed contacts are in electrical communication with the transceiver.

Third and fourth radiating elements are disposed on the dielectric substrate between the free end and the end movably mounted to the housing and may be configured to resonate within the same first and second frequency bands as the first and second radiating elements, respectively. A second set of contacts are provided on the dielectric substrate and serve as means for electrically connecting the third and fourth radiating elements to the radiotelephone transceiver via the same set of fixed contacts within the radiotelephone when the dielectric substrate is in the second extended position.

The first and second radiating elements may resonate within the respective first and second frequency bands as quarter-wave antennas when the substrate is in the retracted position. The third radiating element may combine with the first radiating element to resonate within the first frequency band as a half-wave antenna when the substrate is in the second extended position. Similarly, the fourth radiating element may combine with the second radiating element to resonate within the second frequency band as a half-wave antenna when the substrate is in the second extended position.

A plurality of contacts may be provided along a side portion of the dielectric substrate that are configured to electrically connect accessory contacts, such as from a car cradle, to the radiotelephone transceiver when the dielectric substrate is in the first extended position. Because a separate set of contacts are utilized to connect an accessory to the transceiver, the first, second, third and fourth radiating elements are electrically disconnected from the transceiver when the dielectric substrate is in the first extended position.

Impedance matching components may be provided on the dielectric substrate to match the impedance of the third and fourth radiating elements when the dielectric substrate is in the second extended position. In addition, impedance matching components may be provided on the dielectric substrate to match the impedance of an accessory when the dielectric substrate is in the first extended position.

Retractable antennas according to the present invention may be configured to extend from and pivot away from electronic devices in various ways. For example, an antenna may be configured to pivot from front to back of an electronic device. Alternatively, an antenna may be configured to pivot from side to side of an electronic device.

Electronic devices, such as radiotelephones, incorporating a retractable multi-band antenna according to an embodiment of the present invention may not require impedance matching circuits or complex switching mechanisms to accommodate retracted and extended positions for multiple frequency band operation. Furthermore, the need for separate coaxial connectors and switching mechanisms for electronic device accessories may also be eliminated. A reduction in mechanical parts, which may become unreliable over time, is also a benefit of the present invention. Furthermore, because retractable antennas, according to the present invention, can be pivoted away from a user, the effects of interference caused by the body of a user may be reduced significantly.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
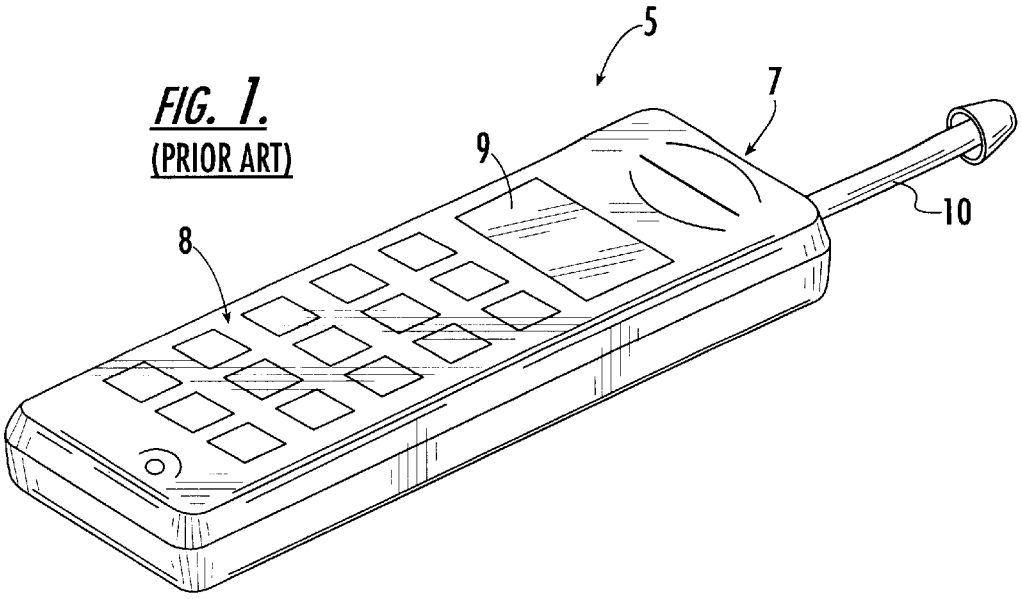
FIG. 1. (PRIOR ART)
FIG. 1 illustrates a radiotelephone with a conventional retractable antenna.

Referring now to FIG. 1, a conventional radiotelephone handset 5 includes a housing 7 that encloses a transceiver (not shown) for transmitting and receiving telecommunications signals, as is known to those skilled in this art. A keypad 8, display window 9, and retractable antenna 10 for receiving or transmitting telecommunications signals, facilitate radiotelephone operation. Other elements of radiotelephones are conventional and need not be described herein.

Figure 2A:
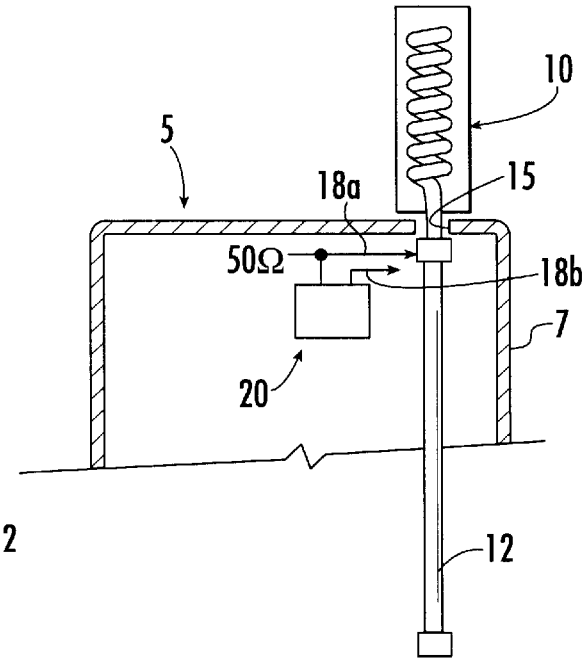
FIG. 2A. (PRIOR ART)
FIG. 2A schematically illustrates impedance matching of a conventional radiotelephone retractable antenna when the antenna is in a retracted position.
Figure 2B:
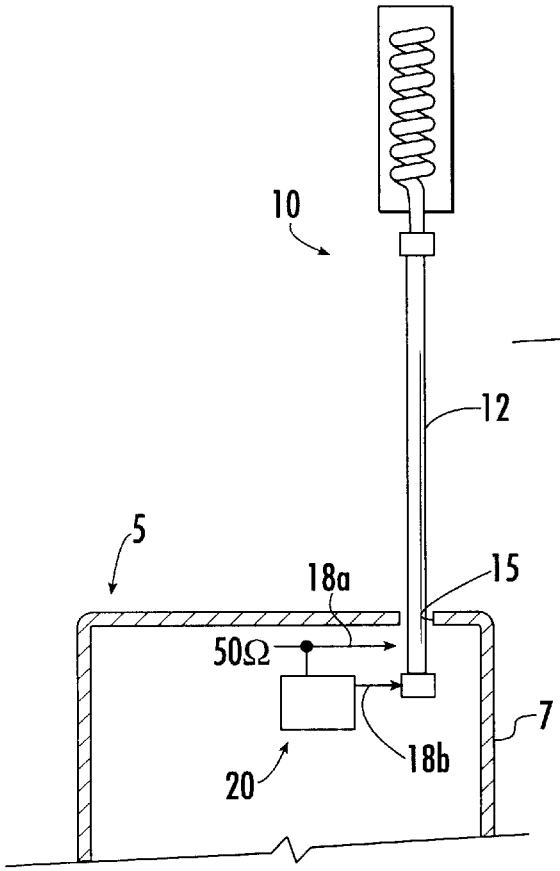
FIG. 2B. (PRIOR ART)
FIG. 2B schematically illustrates impedance matching of the antenna of FIG. 2A when the antenna is in an extended position.

Referring now to FIGS. 2A and 2B, a conventional retractable antenna 10 for a radiotelephone 5 is schematically illustrated. The illustrated retractable antenna 10 includes a linear rod 12 (or other elongated element) slidably mounted within the radiotelephone housing 7, and movable between a retracted position (FIG. 2A) and an extended position (FIG. 2B) through an aperture 15 in the housing 7.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain. Radiation patterns for antennas are often plotted using polar coordinates. Voltage Standing Wave Ratio (VSWR) relates to the impedance match of an antenna feed point with a feed line or transmission line of a communications device, such as a radiotelephone.

Conventional radiotelephones employ an antenna which is electrically connected to a transceiver operably associated with a signal processing circuit positioned on an internally disposed printed circuit board. To radiate radio frequency (RF) energy with minimum loss, or to pass along received RF energy to a radiotelephone receiver with minimum loss, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the circuit feed.

As is known to those skilled in the art of radiotelephones, an impedance matching system 20 may be provided to match the impedance of the retractable antenna 10 to the impedance (conventionally 50Ω) of the radio frequency (RF) circuitry (not shown) of the transceiver. The illustrated impedance matching system 20 employs dual impedance matching circuits. One impedance matching circuit is electrically connected to the linear rod 12 via a feed terminal 18*a* when the linear rod 12 is in a retracted position (FIG. 2A). The other impedance matching circuit is electrically connected to the linear rod 12 via a different feed terminal 18*b* when the linear rod 12 is in an extended position (FIG. 2B). When in a retracted position (FIG. 2A), the antenna 10 conventionally represents a quarter-wave monopole which is matched to 50Ω through the matching network 20 via feed terminal 18*a*. In an extended position (FIG. 2B), the antenna 10 conventionally represents a half-wave monopole which is matched to 50Ω through the matching network 20, via feed terminal 18*b*. Impedance matching systems are well known in the art and need not be discussed further.

Figure 3:
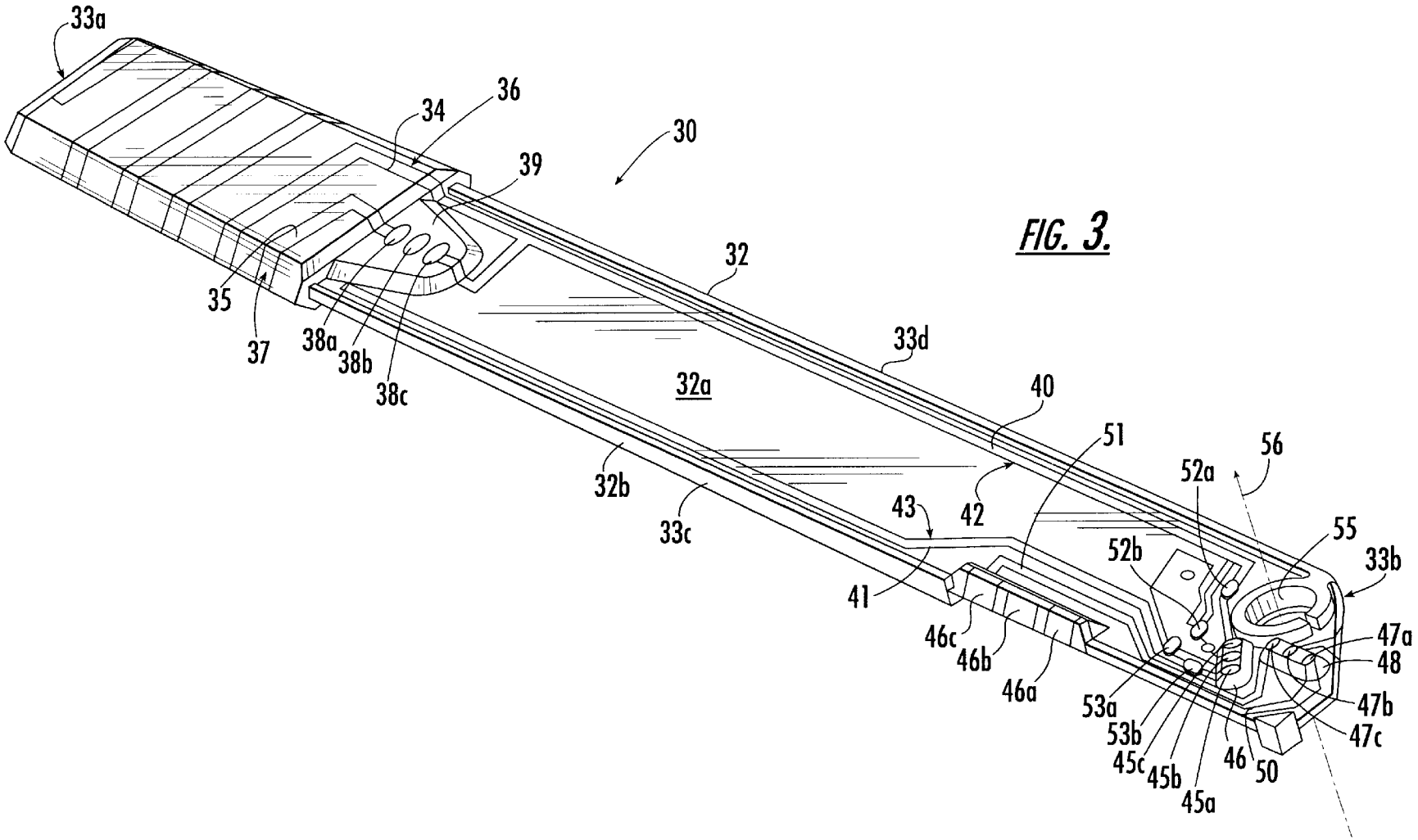
FIGS. 3 and 4 illustrate a pivotable and retractable multiple frequency band antenna according to an embodiment of the present invention.

Referring now to FIG. 3, a retractable multiple frequency band antenna 30 according to an embodiment of the present invention is illustrated. The illustrated retractable antenna 30 includes an elongated dielectric substrate 32 having a generally rectangular configuration with opposite first and second end portions 33*a*, 33*b*, opposite first and second faces 32*a*, 32*b*, and opposite first and second elongated side portions 33*c*, 33*d*. However, it is to be understood that antennas incorporating aspects of the present invention may have various configurations and shapes, and are not limited to the illustrated configuration.

The dielectric substrate 32 is preferably molded or formed from a polymeric material, such as fiberglass, nylon and the like. However, various dielectric materials may be utilized for the dielectric substrate 32 without limitation. Preferably, the dielectric substrate 32 has a dielectric constant between about 4.4 and about 4.8. However, it is to be understood that dielectric substrates having different dielectric constants may be utilized without departing from the spirit and intent of the present invention. Dimensions of the illustrated dielectric substrate 32 may vary depending on the space limitations of a radiotelephone or other communications device within which the antenna 30 is to be incorporated.

A first conductive trace of copper or other conductive material is disposed on the dielectric substrate 32 in a helical configuration around the first end portion 33a thereof, as illustrated, and is indicated as 34. A second conductive trace of copper or other conductive material is also disposed on the dielectric substrate 32 in a helical configuration around the first end portion 33a thereof, as illustrated, and is indicated as 35. Alternatively, the first and second conductive traces 34, 35 may be disposed within the material of the dielectric substrate 32 as would be understood by those skilled in this art.

The first and second conductive traces 34, 35 serve as respective radiating elements 36, 37 for transmitting and receiving radiotelephone communication signals. Preferably, the radiating elements 36, 37 resonate as quarter-wave antennas within different frequency bands when the dielectric substrate 32 is retracted within a radiotelephone housing, as will be described in detail below. For example, radiating element 36 may resonate as a quarter-wave antenna at 800 MHz and radiating element 37 may resonate as a quarter-wave antenna at 1900 MHz. The length, spacing and other geometry of each radiating of the elements 36, 37 is a tuning parameter, as is known to those skilled in the art of antennas. In the illustrated embodiment, the first and second radiating elements 36, 37 have an interleaved configuration.

A plurality of contacts 38*a*, 38*b*, 38*c* are disposed on a raised portion 39 of the dielectric substrate first face 32*a* in adjacent, spaced-apart relationship as illustrated. Radiating element 36 is electrically connected to contact 38*c* and radiating element 37 is electrically connected to contact 38*a*. As will be described in detail below, contacts 38*a*, 38*b*, 38*c* serve as means for electrically connecting radiating elements 36 and 37 to the transceiver within a radiotelephone when the dielectric substrate 32 is in a retracted position.

A third conductive trace of copper or other conductive material is disposed on the dielectric substrate 32 between the first and second end portions 33*a*, 33*b*, as illustrated, and is indicated as 40. A fourth conductive trace of copper or other conductive material is also is disposed on the dielectric substrate 32 between the first and second end portions 33*a*, 33*b*, as illustrated, and is indicated as 41. Alternatively, the conductive material may be disposed within the material of the dielectric substrate 32. The third and fourth conductive traces 40, 41 serve as respective radiating elements 42, 43 for transmitting and receiving radiotelephone communication signals. Preferably, the radiating elements 42, 43 resonate as quarter-wave antennas within different frequency bands.

Furthermore, it is preferred that the radiating elements 42 and 43 combine with respective radiating elements 36 and 37 so as to resonate as half-wave antennas when the dielectric substrate 32 is extended to the second extended position from a radiotelephone housing, as will be described in detail below. For example, radiating elements 36 and 42 may combine to resonate as a half-wave antenna at 800 MHz. The length, spacing and other geometry of each radiating element 42, 43 is a tuning parameter, as is known to those skilled in the art of antennas. Furthermore, radiating elements 42 and 43 may have various shapes and configurations which affect tuning and are not limited to the illustrated embodiment.

A plurality of contacts 45*a*, 45*b*, 45*c* are disposed on a raised portion 46 of the dielectric substrate first face 32*a* adjacent the second end portion 33*b* in adjacent, spaced-apart relationship as illustrated. Radiating element 42 is electrically connected to contact 45*c* and radiating element 43 is electrically connected to contact 45*a*. Contact 45*b* is a ground contact electrically connected to the ground plane 57 on the dielectric substrate second face 32*b*. As will be described in detail below, contacts 45*a*, 45*b*, 45*c* serve as means for electrically connecting radiating elements 42 and 43 to the transceiver within a radiotelephone when the dielectric substrate 32 is in a second extended position wherein the dielectric substrate 32 is pivoted away from the housing 7.

Still referring to FIG. 3, a plurality of accessory contacts 46*a*, 46*b*, 46*c* are provided in adjacent, spaced-apart relationship along side portion 32*b* of the dielectric substrate 32, as illustrated. A plurality of contacts 47*a*, 47*b*, 47*c* are disposed on a raised portion 48 of the dielectric substrate first face 32*a* adjacent the second end portion 33*b*, as illustrated. Accessory contacts 46*a* and 46*c* are electrically connected to respective contacts 47*a* and 47*c* via respective conductive traces 50 and 51. Accessory contact 46*b* is electrically connected with a ground plane disposed on the dielectric substrate second face 32*b*. As will be described in detail below, contacts 47*a*, 47*b*, 47*c* serve as means for electrically connecting accessory contacts 46*a*, 46*b*, 46*c* to the transceiver within a radiotelephone when the dielectric substrate 32 is in a first extended position.

Still referring to FIG. 3, impedance matching components 52*a* and 52*b* are provided for matching the impedance of radiating element 42 to the RF circuitry of the transceiver within a radiotelephone. Impedance matching components 53*a* and 53*b* are provided for matching the impedance of radiating element 43 to the RF circuitry of the transceiver within a radiotelephone.

An aperture 55 is formed in the dielectric substrate 32 adjacent the second end portion 33*b*, as illustrated. Aperture 55 serves as means for allowing the dielectric substrate 32 to pivot with respect to the housing of a radiotelephone when in the second extended position. Aperture 55 may be configured to receive a bearing or other means for allowing the dielectric substrate to rotate about the axial direction (indicated by arrow 56), as would be understood by those skilled in the art. However, it is to be understood that various known methods of pivotally attaching the dielectric substrate 32 to a radiotelephone housing may be utilized, without limitation.

Figure 4:
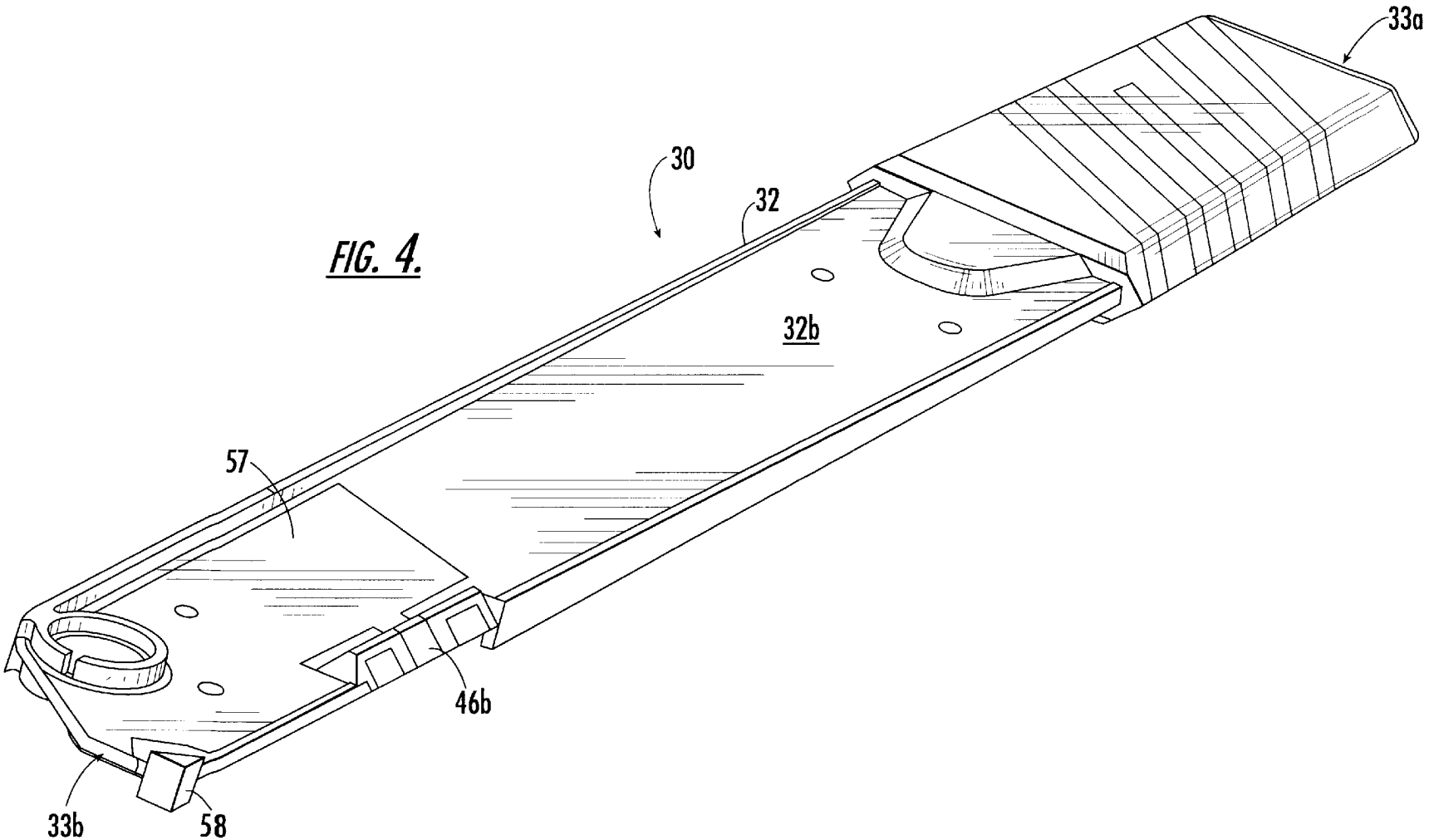

Referring now to FIG. 4, a ground plane 57 is disposed on the dielectric substrate second face 32*b*, as illustrated. Stop member 58 serves as means for holding the dielectric substrate 32 in a tilted position when extended to the second extended position from a radiotelephone housing, as would be understood by those skilled in this art.

Figure 5A:
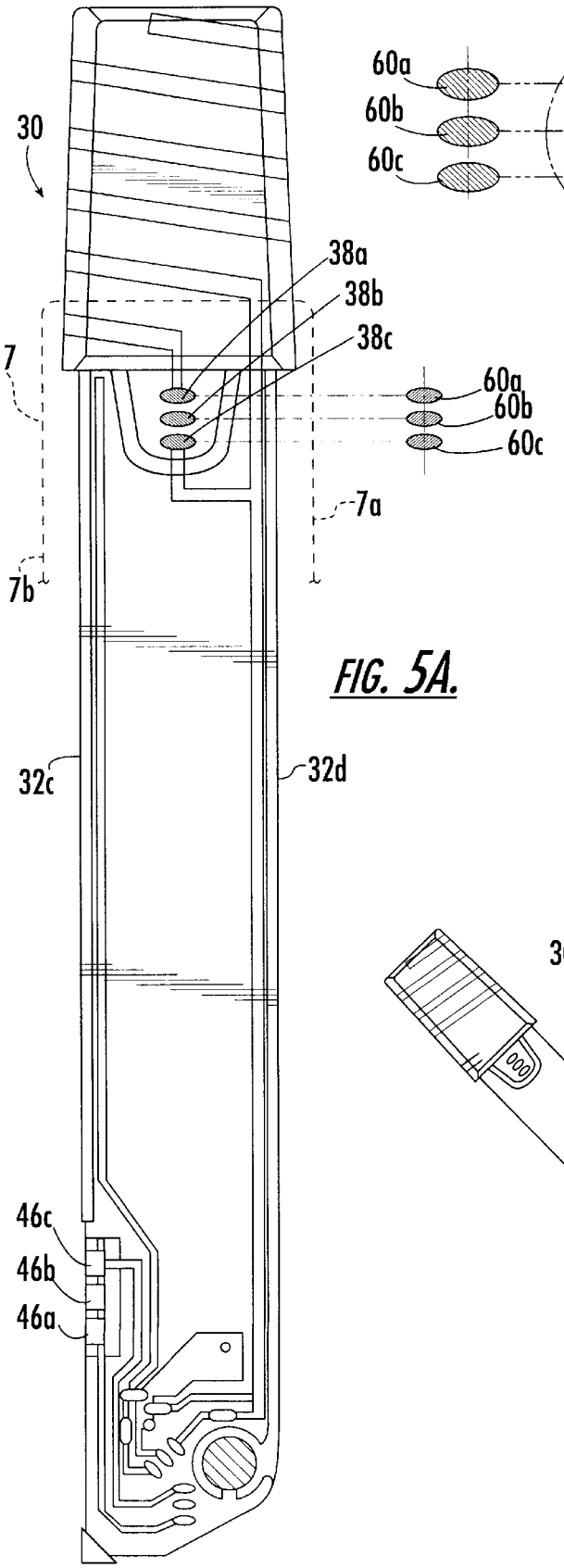
FIGS. 5A–5D illustrate the retractable multiple frequency band antenna of FIGS. 3 and 4 in various extended and retracted positions, according to the present invention.

Referring now to FIGS. 5A–5D, the retractable multiple frequency band antenna 30 of FIGS. 3 and 4 is illustrated in various extended and retracted positions. In FIG. 5A, the retractable multiple frequency band antenna 30 is illustrated in a retracted position within the housing 7 of an electronic device, such as a radiotelephone. In the illustrated configuration, the retractable multiple frequency band antenna 30 is oriented such that side portions 32*c* and 32*d* are substantially perpendicular to the front and rear faces 7*a*, 7*b* of the electronic device housing 7.

A plurality of stationary contacts 60*a*, 60*b*, 60*c* are provided within the electronic device housing 7. The stationary contacts 60*a*, 60*b*, 60*c* are electrically connected to a transceiver within the electronic device housing, as would be understood by those skilled in this art. When the antenna 30 is in a retracted position, as illustrated in FIG. 5A, the contacts 38*a*, 38*b*, 38*c* are in contacting relationship with the stationary contacts 60*a*, 60*b*, 60*c*. Accordingly, when in the retracted position, the radiating elements 36 and 37 (FIG. 3) serve as the operational antennas for the electronic device. Radiating element 43 is not electrically connected to the transceiver when the antenna 30 is in the retracted position.

Figure 5B:
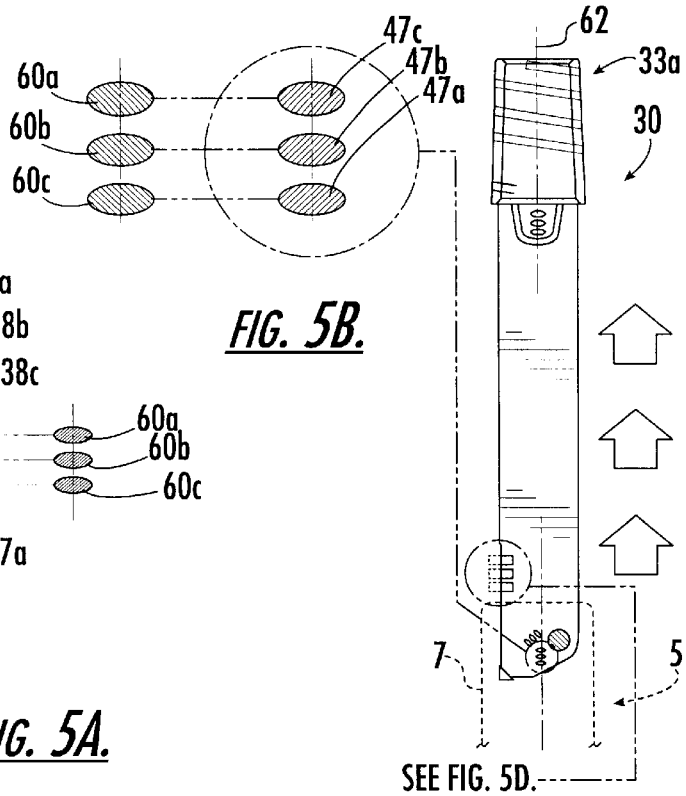

Referring to FIG. 5B, the antenna 30 is illustrated in a first extended position. The electronic device housing 7 defines a longitudinal direction, indicated by 62. In the first extended position, the dielectric substrate 32 is substantially parallel with the longitudinal direction as illustrated. In the first extended position, end portion 33*a* is extended outwardly from the housing 7 as illustrated. The contacts 47*a*, 47*b*, 47*c* are in contacting relationship with the stationary contacts 60*a*, 60*b*, 60*c*, as illustrated. Accordingly, when the antenna 30 is in the first extended position, the accessory contacts 46*a*, 46*b*, 46*c* are electrically connected to the transceiver. Because the radiating elements 36, 37 and 42, 43 (FIG. 3) are not electrically connected to the contacts 47*a*, 47*b*, 47*c*, the radiating elements 36, 37 and 42 are effectively disconnected from the transceiver when the antenna 30 is in the first extended position.

An electronic device incorporating a retractable antenna 30 according to the illustrated embodiment of FIGS. 5A–5D is configured to be electrically connected to an accessory when the antenna 30 is in the first extended position. As illustrated in FIG. 5B, and the enlarged view of FIG. 5D, the accessory contacts 46*a*, 46*b*, 46*c* are configured to engage in contacting relationship with the respective contacts 64*a*, 64*b*, 64*c* of an accessory, such as a car cradle when the antenna 30 is in the first extended position.

Figure 5C:
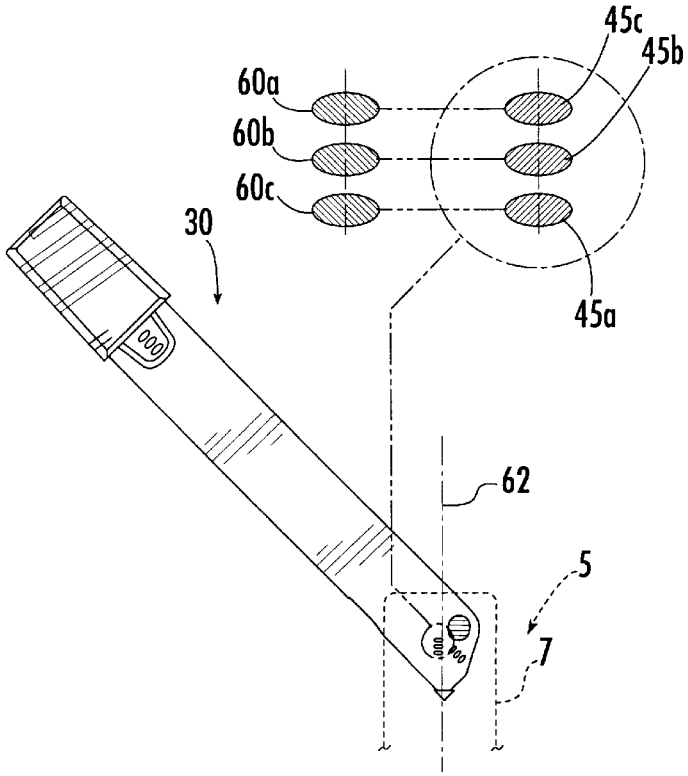
Figure 5D:
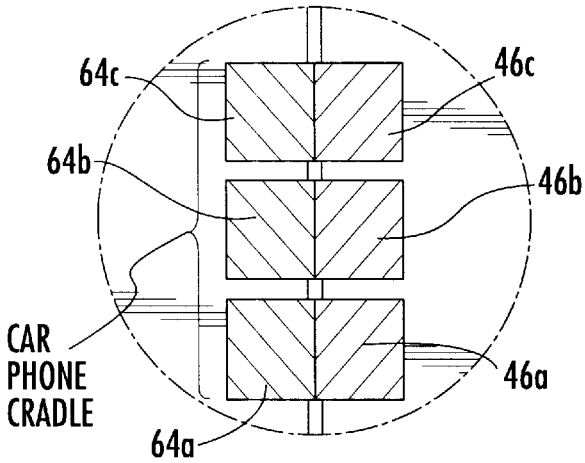

Referring now to FIG. 5C, the retractable antenna 30 is illustrated in a second extended or tilted position. The antenna 30 is preferably configured to be positioned away from the head of a user at an angle sufficient to reduce the effects of interference that may be caused by a user's body. As illustrated, the antenna 30 extends in a direction that is substantially transverse to the longitudinal direction 62 defined by the electronic device housing 7.

As illustrated in FIG. 5C, the contacts 45*a*, 45*b*, 45*c* are in contacting relationship with the stationary contacts 60*a*, 60*b*, 60*c* within the electronic device. Accordingly, when in the second extended position, the radiating elements 42 and 43 in combination with radiating element 36 (FIG. 3) serve as the operational antennas for the electronic device. Preferably, radiating elements 42 and 36 are electrically connected such that they combine to resonate as a half-wave antenna in a particular frequency band when the dielectric substrate 32 is in the second extended position.

Accordingly, electronic devices incorporating a retractable multi-band antenna according to the present invention may not require impedance matching circuits or complex switching mechanisms to accommodate retracted and extended positions for multiple frequency band operation. Furthermore, the need for separate coaxial connectors and switching mechanisms for electronic device accessories may also be eliminated. Because the retractable antenna, according to the present invention, can be pivoted away from a user, the effects of interference caused by the body of a user may be reduced significantly.

It is also to be understood that the present invention is not limited to multiple frequency band antennas. The present invention may also be utilized by single frequency band retractable antennas. For example, a single radiating element may be provided adjacent the first end portion 33*a* of the illustrated dielectric substrate for use when the antenna 30 is in a retracted position. A single radiating element may be provided between the first and second end portions 33*a*, 33*b* for use when the antenna 30 is in an extended position.

Figure 7:
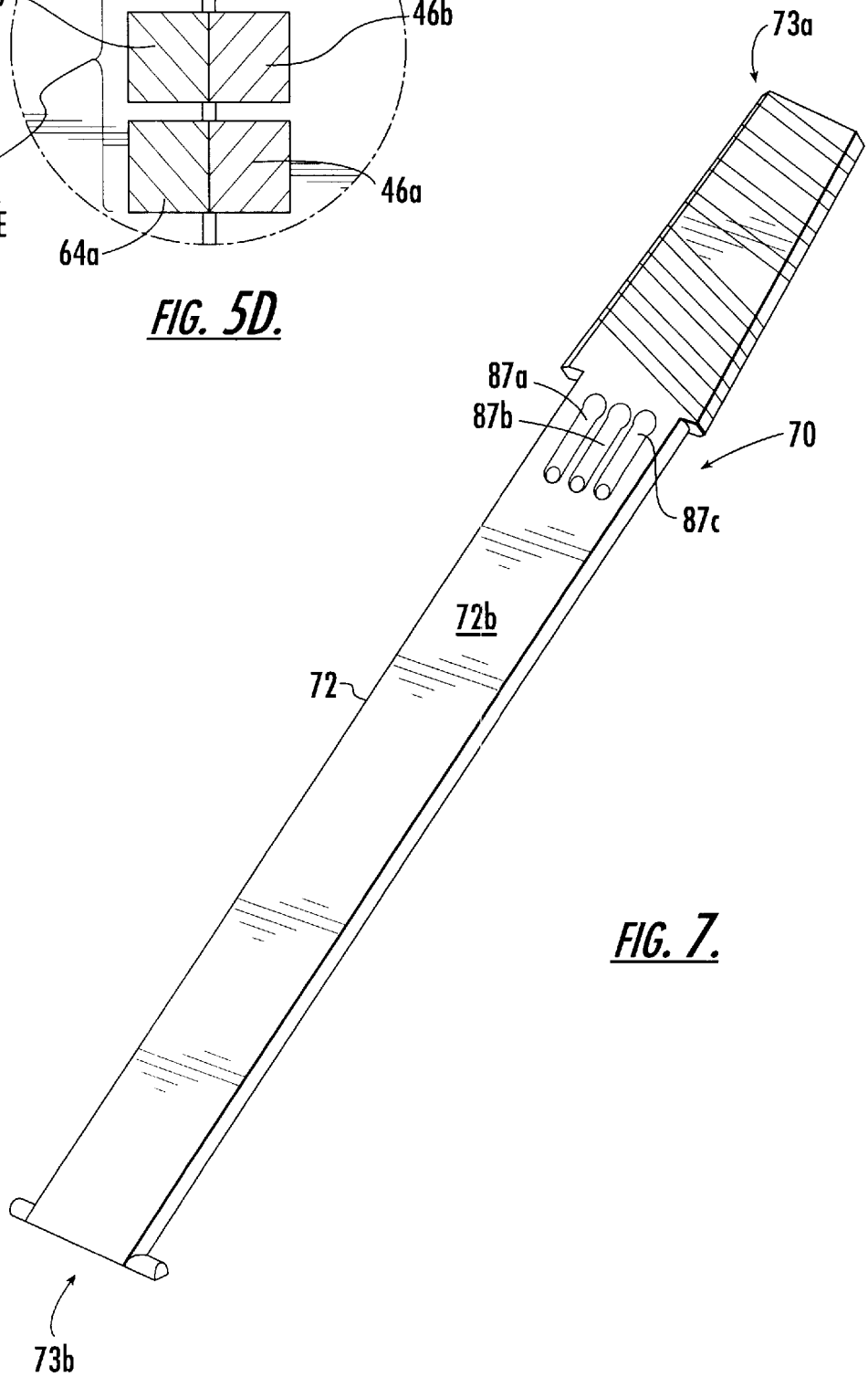
FIGS. 6 and 7 illustrate a pivotable and retractable multiple frequency band antenna according to another embodiment of the present invention.
Figure 6:
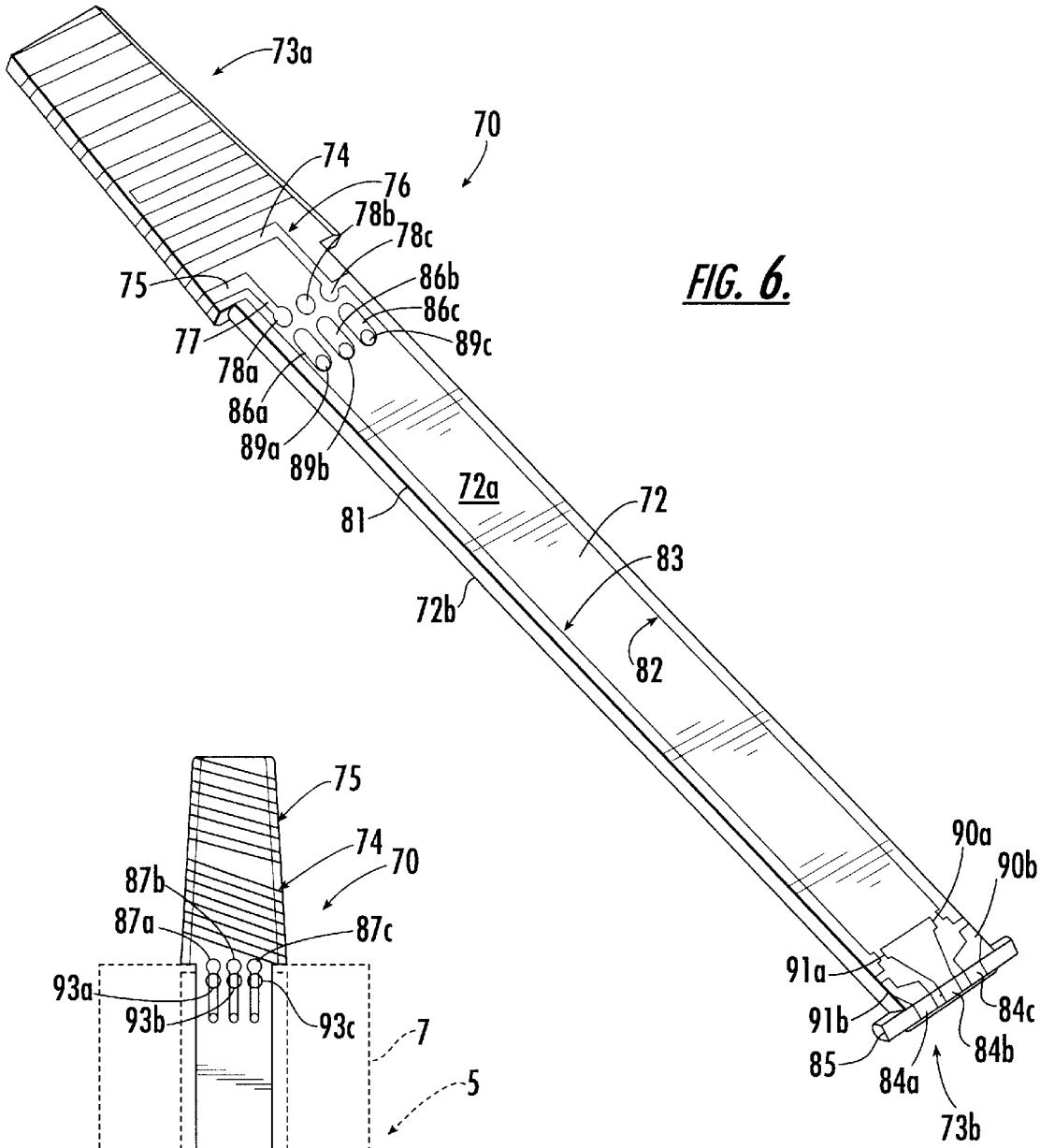

Referring now to FIGS. 6 and 7 a retractable, multiple frequency band antenna 70 according to another embodiment of the present invention is illustrated. The illustrated retractable antenna 70 includes an elongated dielectric substrate 72 having a generally rectangular configuration with opposite first and second end portions 73*a*, 73*b* and opposite first and second faces 72*a*, 72*b*.

The dielectric substrate 72 is preferably molded or formed from a polymeric material, such as fiberglass, nylon and the like. However, various dielectric materials may be utilized for the dielectric substrate 72 without limitation. Preferably, the dielectric substrate 72 has a dielectric constant between about 4.4 and about 4.8. However, it is to be understood that dielectric substrates having different dielectric constants may be utilized without departing from the spirit and intent of the present invention. Dimensions of the illustrated dielectric substrate 72 may vary depending on the space limitations of a radiotelephone or other communications device within which the antenna 70 is to be incorporated.

A first conductive trace of copper or other conductive material is disposed on the dielectric substrate 72 in a helical configuration around the first end portion 73*a* thereof, as illustrated, and is indicated as 74. A second conductive trace of copper or other conductive material is also disposed on the dielectric substrate 72 in a helical configuration around the first end portion 73*a* thereof, as illustrated, and is indicated as 75. In the illustrated embodiment, the first and second radiating elements 74, 75 have an interleaved configuration.

The first and second conductive traces 74, 75 serve as respective radiating elements 76, 77 for transmitting and receiving radiotelephone communication signals. Preferably, the radiating elements 76, 77 resonate as quarter-wave antennas within different frequency bands when the dielectric substrate 72 is retracted within a radiotelephone housing, as will be described in detail below. For example, radiating element 76 may resonate as a quarter-wave antenna at 800 MHz and radiating element 77 may resonate as a quarter-wave antenna at 1900 MHz.

A plurality of contacts 78*a*, 78*b*, 78*c* are disposed on the dielectric substrate first face 72*a* in adjacent, spaced-apart relationship as illustrated. Radiating element 76 is electrically connected to contact 78*c* and radiating element 77 is electrically connected to contact 78*a*. Contact 78*b* is a ground contact. As will be described in detail below, contacts 78*a*, 78*b*, 78*c* serve as means for electrically connecting radiating elements 76 and 77 to the transceiver within a radiotelephone when the antenna 70 is in a retracted position.

A third conductive trace of copper or other conductive material is disposed on the dielectric substrate 72 between the first and second end portions 73*a*, 73*b*, as illustrated, and is indicated as 80. A fourth conductive trace of copper or other conductive material is also is disposed on the dielectric substrate 72 between the first and second end portions 73*a*, 73*b*, as illustrated, and is indicated as 81. The third and fourth conductive traces 80, 81 serve as respective radiating elements 82, 83 for transmitting and receiving radiotelephone communication signals. Preferably, the radiating elements 82, 83 resonate as quarter-wave antennas within different frequency bands. Furthermore, it is preferred that the radiating element 82 combine with radiating element 74 so as to resonate as a half-wave antenna when the antenna 70 is extended from a radiotelephone housing, as will be described in detail below. For example, radiating elements 76 and 80 may combine to resonate as a half-wave antenna at 800 MHz.

A plurality of contacts 84*a*, 84*b*, 84*c* are disposed on a pivot pin 85 located at the dielectric substrate second end portion 73*b*,*in* adjacent spaced-apart relationship as illustrated. Radiating element 82 is electrically connected to contact 84*c* and radiating element 83 is electrically connected to contact 84*a*. Contact 84*b* is a ground contact. As will be described in detail below, contacts 84*a*, 84*b*, 84*c* serve as means for electrically connecting radiating elements 82 and 83 to the transceiver within a radiotelephone when the antenna 70 is in a second extended or tilted position.

A plurality of accessory contacts 86*a*, 86*b*, 86*c* are provided in spaced-apart adjacent relationship on the dielectric substrate first face 72*a* adjacent contacts 78*a*, 78*b*, 78*c*, as illustrated in FIG. 6. A plurality of contacts 87*a*, 87*b*, 87*c* are disposed on the second face 72*b* of the dielectric substrate first face 72*a*, as illustrated in FIG. 7. Accessory contacts 86*a*, 86*b*, 86*c* are electrically connected to respective contacts 87*a*, 87*b*, 87*c* through respective vias 89*a*, 89*b*, 89*c* formed in the dielectric substrate 72. Accessory contact 86*b* is electrically connected with a ground plane (not shown) disposed on the dielectric substrate second face 72*b*. Antenna ground planes are well understood by those skilled in this art and need not be described further herein. As will be described in detail below, contacts 87*a*, 87*b*, 87*c* serve as means for electrically connecting accessory contacts 86*a*, 86*b*, 86*c* to a transceiver within a radiotelephone when the antenna 70 is in a first extended position.

Referring to FIG. 6, impedance matching components 90*a* and 90*b* are provided for matching the impedance of radiating element 82 to the RF circuitry of a transceiver within a radiotelephone. Impedance matching components 91*a* and 91*b*, which are filled with passive components (not shown), are provided for matching the impedance of radiating element 83 to the RF circuitry of a transceiver within a radiotelephone. The pivot pin 85 located at the dielectric substrate second end portion 73*b*, serves as means for holding the dielectric substrate 72 in a tilted position when extended from a radiotelephone housing.

Figure 8A:
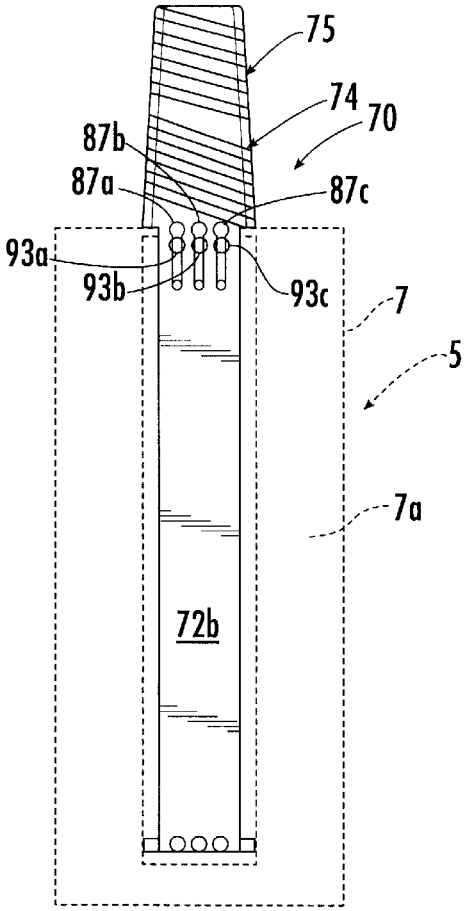
FIGS. 8A–8E illustrate the retractable multiple frequency band antenna of FIGS. 6 and 7 in various extended and retracted positions, according to the present invention.

Referring now to FIGS. 8A–8E, the retractable multiple frequency band antenna 70 of FIGS. 6 and 7 is illustrated in various extended and retracted positions. In FIG. 8A, the retractable multiple frequency band antenna 70 is illustrated in a retracted position within the housing 7 of an electronic device 5, such as a radiotelephone. In the illustrated configuration, the retractable multiple frequency band antenna 70 is oriented such that the dielectric substrate first and second faces 72*a*, 72*b* are substantially facing the front and rear faces 7*a*, 7*b* of the electronic device housing 7.

A plurality of stationary contacts 93*a*, 93*b*, 93*c* are provided within the electronic device housing 7, as illustrated. The stationary contacts 93*a*, 93*b*, 93*c* are electrically connected to a transceiver (not shown) within the electronic device housing 7. When the antenna 70 is in a retracted position, as illustrated in FIG. 8A, the contacts 78*a*, 78*b*, 78*c* on the dielectric substrate first face 72*a* are in contacting relationship with the stationary contacts 93*a*, 93*b*, 93*c*. Accordingly, when in the retracted position, the radiating elements 74 and 75 (FIG. 6) serve as the operational antennas for the electronic device and radiating element 82 is not electrically connected to the transceiver.

Figure 8B:
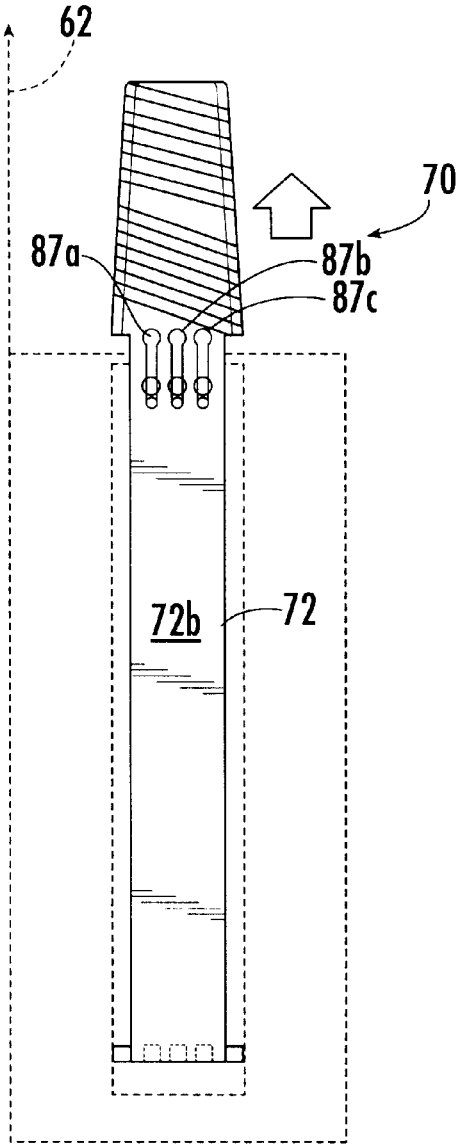
Figure 8C:
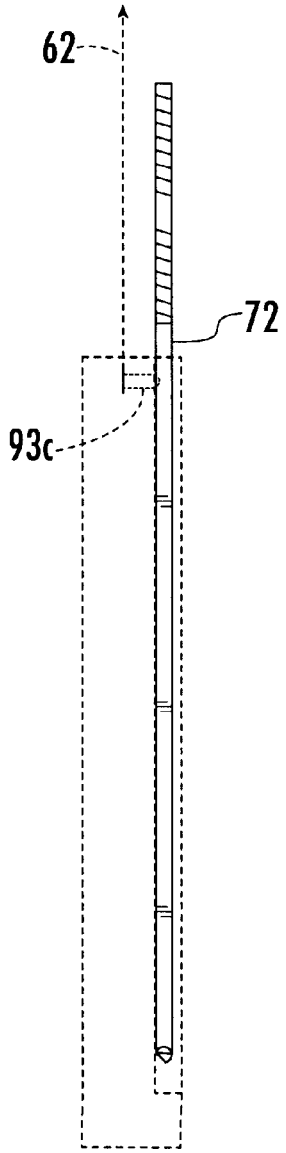

Referring now to FIGS. 8B and 8C, the pivotable, retractable antenna 70 is illustrated in a first extended position. FIG. 8C is a side elevational view of the electronic device of FIG. 8B illustrating the stationary contacts electrically connected to the contacts 87*a*, 87*b*, 87*c* when the antenna 70 is in the first extended position. The electronic device housing 7 defines a longitudinal direction indicated by 62. In the first extended position, the dielectric substrate 72 is substantially parallel with the longitudinal direction 62 as illustrated. In the first extended position, the contacts 86*a*, 86*b*, 86*c* are exposed from the housing 7 such that they may make electrical contact with respective contacts of an accessory, such as a car cradle (not shown). Because of the elongated configuration of contacts 87*a*, 87*b*, 87*c*, the stationary contacts 93*a*, 93*b*, 93*c* within the electronic device are still in contact with contacts 87*a*, 87*b*, 87*c* when the antenna 70 is in the first extended position. Accordingly, an accessory is electrically connected to the transceiver and radiating elements 76, 77 and 82, 83 are not electrically connected to the transceiver.

Figure 8D:
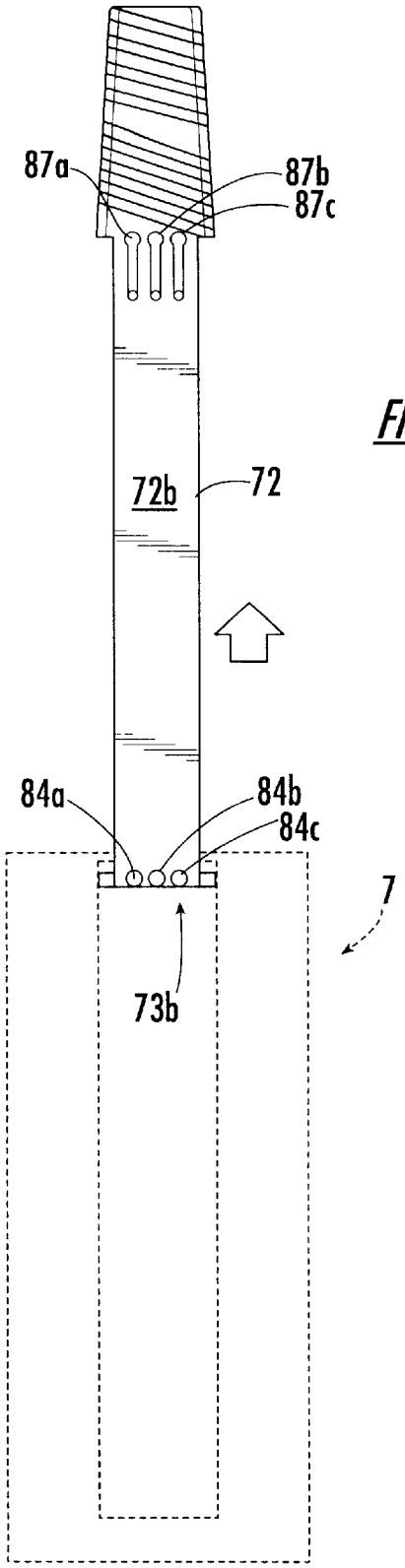
Figure 8E:
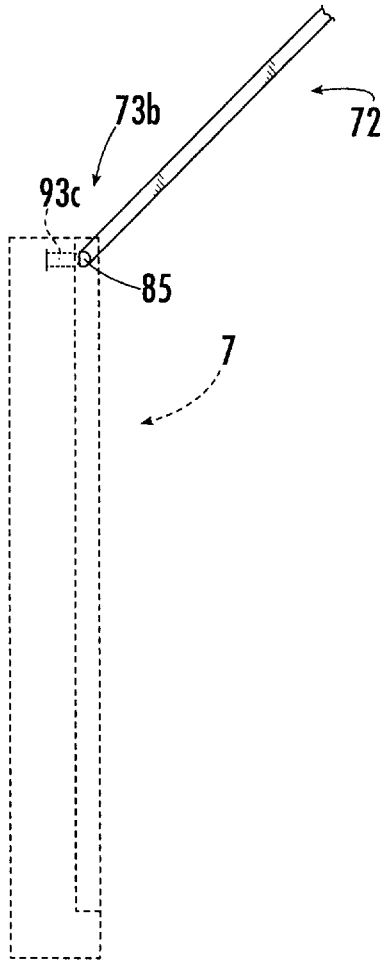

Referring now to FIGS. 8D and 8E, the pivotable, retractable antenna 70 is illustrated in a second extended or tilted position. In FIG. 8D, the antenna 70 is extended outwardly from the housing 7 substantially parallel with the longitudinal direction 62 defined by the housing 7 and then from the housing as shown in FIG. 8E. The antenna 70 is preferably configured to be positioned away from the head of a user at an angle sufficient to reduce the effects of interference that may be caused by a user's body. As illustrated, the antenna 70 extends in a direction that is substantially transverse to the longitudinal direction 62 defined by the electronic device housing 7.

As illustrated in FIG. 8E, the contacts 84*a,* 84*b,* 84*c* are in contacting relationship with the stationary contacts 93*a,* 93*b,* 93*c* when the antenna is tilted away from the electronic device housing 7. Accordingly, when in the second extended position, the radiating elements 82 and 83, in combination with radiating element 76, serve as the operational radiating elements for the electronic device.

As illustrated, radiating element 76 is electrically connected such that they combine to resonate as a half-wave antenna in a particular frequency band when the dielectric substrate 72 is in an extended position.

Accordingly, electronic devices incorporating a retractable multi-band antenna according to the present invention may not require impedance matching circuits or complex switching mechanisms to accommodate retracted and extended positions for multiple frequency band operation. Furthermore, the need for separate coaxial connectors and switching mechanisms for electronic device accessories may also be eliminated. Because the retractable antenna, according to the present invention, can be pivoted away from a user, the effects of interference caused by the body of a user may be reduced significantly.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A retractable and pivotable antenna for an electronic device, said electronic device including first and second contacts connected to respective signal transmission lines from a transceiver within said electronic device, said antenna comprising:

a dielectric substrate comprising opposite first and second ends, said dielectric substrate second end movably mounted to said electronic device such that said dielectric substrate is extendible from said electronic device so as to have:

a first extended position such that said dielectric substrate extends alone a first direction;

a second extended position wherein said dielectric substrate first end is pivoted away from said electronic device such that said dielectric substrate extends in a second direction that is transverse to the first direction; and a retracted position;

a first radiating element disposed on said dielectric substrate adjacent said first end, said first radiating element configured to resonate within a first frequency band;

means for electrically connecting said first radiating element to said first contact when said dielectric substrate is in said retracted position;

a second radiating element disposed on said dielectric substrate between said first and second ends, said second radiating element configured to resonate within said first frequency band; and means for electrically connecting said first and second radiating elements to said first contact when said dielectric substrate is in said second extended position.

2. An antenna according to claim 1 wherein said first radiating element resonates within said first frequency band as a quarter-wave antenna when said substrate is in said retracted position.

3. An antenna according to claim 1 wherein said second radiating element resonates within said first frequency band as a quarter-wave antenna when said substrate is in said second extended position.

4. An antenna according to claim 1 wherein said first and second radiating elements resonate jointly within said first frequency band as a half-wave antenna when said substrate is in said second extended position.

5. An antenna according to claim 1 further comprising:

a third radiating element disposed on said dielectric substrate adjacent said first end, said third radiating element configured to resonate within a second frequency band different from said first frequency band;

means for electrically connecting said third radiating element to said second contact when said dielectric substrate is in said retracted position;

a fourth radiating element disposed on said dielectric substrate between said first and second ends, said fourth radiating element configured to resonate within said second frequency band; and means for electrically connecting said fourth radiating element to said second contact when said dielectric substrate is in said second extended position.

6. An antenna according to claim 5 wherein said third radiating element resonates within said second frequency band as a quarter-wave antenna when said substrate is in said retracted position.

7. An antenna according to claim 5 wherein said fourth radiating element resonates within said second frequency band as a quarter-wave antenna when said substrate is in said second extended position.

8. An antenna according to claim 5 wherein said third and fourth radiating elements resonate jointly within said second frequency band as a half-wave antenna when said substrate is in said second extended position.

9. An antenna according to claim 1 further comprising first means for matching an impedance of said second radiating element to said first contact when said dielectric substrate is in said second extended position, said first impedance matching means disposed on said dielectric substrate.

10. An antenna according to claim 5 further comprising second means for matching an impedance of said fourth radiating element to said second contact when said dielectric substrate is in said second extended position, said second impedance matching means disposed on said dielectric substrate.

11. An antenna according to claim 1 further comprising means for electrically connecting an accessory to said first contact when said dielectric substrate is in said first extended position.

12. An antenna according to claim 11 further comprising means for electrically connecting an accessory to said second contact when said dielectric substrate is in said first extended position.

13. An antenna according to claim 12 wherein said first and second radiating elements are electrically disconnected from said first and second contacts when said dielectric substrate is in said first extended position.

14. An antenna according to claim 11 further comprising third means for matching an impedance of said accessory to said first contact when said dielectric substrate is in said first extended position, said third impedance matching means disposed on said dielectric substrate.

15. An antenna according to claim 1 further comprising a ground plane disposed on said dielectric substrate.

16. A radiotelephone, comprising:

a radiotelephone housing configured to enclose a radiotelephone transceiver, said radiotelephone housing defining a longitudinal direction;

a dielectric substrate comprising opposite first and second ends, said second end movably mounted to said radiotelephone housing such that said dielectric substrate has:

a first extended position such that said dielectric substrate extends along said longitudinal direction;

a second extended position wherein said dielectric substrate first end is pivoted away from said radiotelephone such that said dielectric substrate extends along a second direction that is transverse to said longitudinal direction; and a retracted position;

first and second radiating elements disposed on said dielectric substrate adjacent said first end, said first and second radiating elements configured to resonate within respective first and second frequency bands;

means for electrically connecting said first and second radiating elements to said transceiver when said dielectric substrate is in said retracted position;

third and fourth radiating elements disposed on said dielectric substrate between said first and second ends, said third and fourth radiating elements configured to resonate within said first and second frequency bands, respectively; and means for electrically connecting said third and fourth radiating elements to said transceiver when said dielectric substrate is in said second extended position.

17. A radiotelephone according to claim 16 wherein said first radiating element resonates within said first frequency band as a quarter-wave antenna when said substrate is in said retracted position.

18. A radiotelephone according to claim 16 wherein said second radiating element resonates within said second frequency band as a quarter-wave antenna when said substrate is in said retracted position.

19. A radiotelephone according to claim 16 wherein said third radiating element resonates within said first frequency band as a half-wave antenna when said substrate is in said second extended position.

20. A radiotelephone according to claim 16 wherein said fourth radiating element resonates within said second frequency band as a half-wave antenna when said substrate is in said second extended position.

21. A radiotelephone according to claim 16 wherein said first and third radiating elements jointly resonate within said second frequency band as a half-wave antenna when said substrate is in said second extended position.

22. A radiotelephone according to claim 16 further comprising first means for matching an impedance of said third radiating element when said dielectric substrate is in said second extended position, said first impedance matching means disposed on said dielectric substrate.

23. A radiotelephone according to claim 16 further comprising second means for matching an impedance of said fourth radiating element when said dielectric substrate is in said second extended position, said second impedance matching means disposed on said dielectric substrate.

24. A radiotelephone according to claim 16 further comprising means for electrically connecting an accessory to said transceiver when said dielectric substrate is in said first extended position.

25. A radiotelephone according to claim 24 wherein said first, second, third and fourth radiating elements are electrically disconnected from said transceiver when said dielectric substrate is in said first extended position.

26. A radiotelephone according to claim 24 further comprising third means for matching an impedance of said accessory when said dielectric substrate is in said first extended position, said third impedance matching means disposed on said dielectric substrate.

27. A movable, flat blade antenna for a radiotelephone said radiotelephone including a housing defining a longitudinal direction and a transceiver with a signal transmission line connected thereto that terminates at a contact within said radiotelephone, said antenna movably mounted to said radiotelephone housing such that said antenna has a stored position and an extended position wherein said antenna is pivoted away from said radiotelephone in a direction transverse to said longitudinal direction, said antenna comprising:

first means for electrically connecting said antenna to said contact when said antenna is in said stored position;

second means for electrically connecting said antenna to said contact when said antenna is in said extended position; and means for electrically connecting an accessory to said contact via said antenna, and wherein said accessory connecting means comprises means for electrically disconnecting said antenna from said contact.

28. An antenna according to claim 27 wherein said antenna is configured to resonate in at least one frequency band as a quarter-wave antenna when in said stored position and is configured to resonate in said at least one frequency band as a half-wave antenna when in said extended position.

29. An antenna according to claim 27 further comprising first means for matching an impedance of said antenna to said signal transmission line when said antenna is in said stored position, said first impedance matching means disposed on said antenna.

30. An antenna according to claim 27 further comprising second means for matching an impedance of said antenna to said signal transmission line when said antenna is in said extended position, said second impedance matching means disposed on said antenna.

31. An antenna according to claim 27 wherein said antenna resonates within multiple frequency bands in said extended and stored positions.

32. A movable, flat blade antenna for a radiotelephone, said radiotelephone including a housing defining a longitudinal direction and a transceiver with a signal transmission line connected thereto that terminates at a contact within said radiotelephone, said antenna movably mounted to said radiotelephone housing such that said antenna has a stored position and an extended position wherein said antenna is pivoted away from said radiotelephone in a direction transverse to said longitudinal direction, said antenna comprising:

first means for electrically connecting said antenna to said contact when said antenna is in said stored position;

second means for electrically connecting said antenna to said contact when said antenna is in said extended position;

first means for matching an impedance of said antenna to said signal transmission line when said antenna is in said stored position, said first impedance matching means disposed on said antenna; and wherein said antenna is configured to resonate in at least one frequency band as a quarter-wave antenna when in said stored position and is configured to resonate in said at least one frequency band as a half-wave antenna when in said extended position.

33. A flat blade antenna according to claim 32 further comprising means for electrically connecting an accessory to said contact via said antenna.

34. A flat blade antenna according to claim 33 wherein said accessory connecting means comprises means for electrically disconnecting said antenna from said contact.

35. A flat blade antenna according to claim 32 further comprising second means for matching an impedance of said antenna to said-signal transmission line when said antenna is in said extended position, said second impedance matching means disposed on said antenna.

36. A flat blade antenna according to claim 32 wherein said antenna resonates within multiple frequency bands in said extended and stored positions.

37. A movable, flat blade antenna for a radiotelephone, said radiotelephone including a housing defining a longitudinal direction and a transceiver with a signal transmission line connected thereto that terminates at a contact within said radiotelephone, said antenna comprising:

a flat dielectric substrate comprising opposite first and second ends, opposite first and second faces, and a pivot pin extending outwardly from the second end, wherein the pivot pin extends along a plane substantially parallel with said first and second faces, wherein said dielectric substrate is movably mounted to said radiotelephone such that said dielectric substrate has a stored position and an extended position wherein said antenna is pivoted away from said radiotelephone via said pivot pin in a direction transverse to said longitudinal direction;

first means for electrically connecting said antenna to said contact when said antenna is in said stored position;

second means on said pivot pin for electrically connecting said antenna to said contact when said antenna is in said extended position; and first means for matching an impedance of said antenna to said signal transmission line when said antenna is in said stored position, said first impedance matching means disposed on said antenna.

* * * * *